United States Patent [19]

McFadden et al.

[11] Patent Number: 4,469,272

[45] Date of Patent: Sep. 4, 1984

[54] FOLDABLE CONTAINER

[75] Inventors: Michael B. McFadden, Holland; Randal M. Honeysett, Plainwell, both of Mich.

[73] Assignee: W. J. Bradford Paper Company, Holland, Mich.

[21] Appl. No.: 432,981

[22] Filed: Oct. 6, 1982

[51] Int. Cl.[3] ..... B65D 5/48

[52] U.S. Cl. ..... 229/28 R; 229/15; 229/34 B; 229/42

[58] Field of Search ..... 229/15, 27, 28 R, 34 B, 229/34 HW, 42, 6 A

[56] References Cited

U.S. PATENT DOCUMENTS 3,861,579 1/1975 Manis et al. ..... 229/23 R

*Primary Examiner*—William Price
*Assistant Examiner*—Gary E. Elkins
*Attorney, Agent, or Firm*—Wood, Herron & Evans

[57] ABSTRACT

In combination, a partitioned insert and a separate enclosure having a bottom, side walls, end walls and an open interior adapted to receive the insert are provided, which form a compartmentalized container in which outward movement of the insert from the enclosure is prevented by anchoring flaps formed on each of the side walls.

10 Claims, 2 Drawing Figures

FOLDABLE CONTAINER

FIELD OF THE INVENTION

This invention relates generally to foldable containers, and more particularly to containers having separate partitioned inserts forming a plurality of compartments.

BACKGROUND OF THE INVENTION

Compartmentalized containers formed of sheet material such as cardboard are typically fabricated in two separate parts. The bottom, side walls and end walls are formed from a single blank of sheet material and foldably interconnected to form an enclosure with an open interior. A separate insert formed of intersecting partitions is then disposed within the interior of the enclosure to form a container having a plurality of compartments for holding items of different size, shape and the like.

In many instances, it is desirable to form the enclosure and/or insert with means to secure the insert within the enclosure so that the entire container may be turned upside down without the insert falling out. Many prior art two piece compartmentalized containers either do not provide means to secure the insert in place or include relatively complicated securing means which add cost to both the fabricating and assembly operations of the container.

It is therefore an object of this invention to provide a container having an enclosure with an open interior adapted to receive and secure a partitioned insert therewithin.

It is another object of this invention to provide a container which includes, in combination, an open-topped enclosure and an insert adapted to be secured within the enclosure so that the entire container may be turned upside down without the insert falling out.

It is still another object of this invention to provide a container having an enclosure with an open interior adapted to receive and secure a partitioned insert therewithin which is economical to fabricate and assemble.

SUMMARY OF THE INVENTION

These and other objectives are accomplished in this invention of a container including an enclosure having an open interior which is adapted to receive and secure a partitioned insert therewithin. The enclosure is formed from a single blank of sheet material such as cardboard or the like and includes a bottom section, two side walls and two end walls. The side walls and end walls are foldable in an upright position relative to the bottom section and are adapted to interconnect to form a generally rectangular-shaped enclosure having an open interior. The side walls include an upper end formed with a flap which is foldable inwardly and downwardly toward the open interior and bottom section of the enclosure.

An insert is also provided having a plurality of spaced, parallel first partitions and a plurality of spaced, parallel second partitions. The first and second partitions are interconnected perpendicularly to one another to form a plurality of compartments. The insert is disposed within the open interior of the enclosure such that the first partitions are generally perpendicular to the side walls and the second partitions are generally perpendicular to the end walls. An L-shaped notch is cut out of the upper corners of each first partition forming a vertical edge extending from the top of the first partition toward the bottom to a ledge section extending generally parallel to the plane of the bottom section of the container. To secure the insert within the interior of the container, the flaps of the side walls are folded downwardly and are resiliently biased inwardly into engagement with each of the notches formed in the first partitions of the insert. The flaps tend to urge the insert downwardly and resist movement of the insert outwardly from the enclosure when the container is tipped upside down to remove the contents therefrom.

DESCRIPTION OF THE DRAWINGS

The structure, operation and advantages of this invention will become apparent upon consideration of the following description taken in conjunction with the accompanying drawings, wherein.

DETAILED DESCRIPTION OF THE INVENTION

Figure 1:
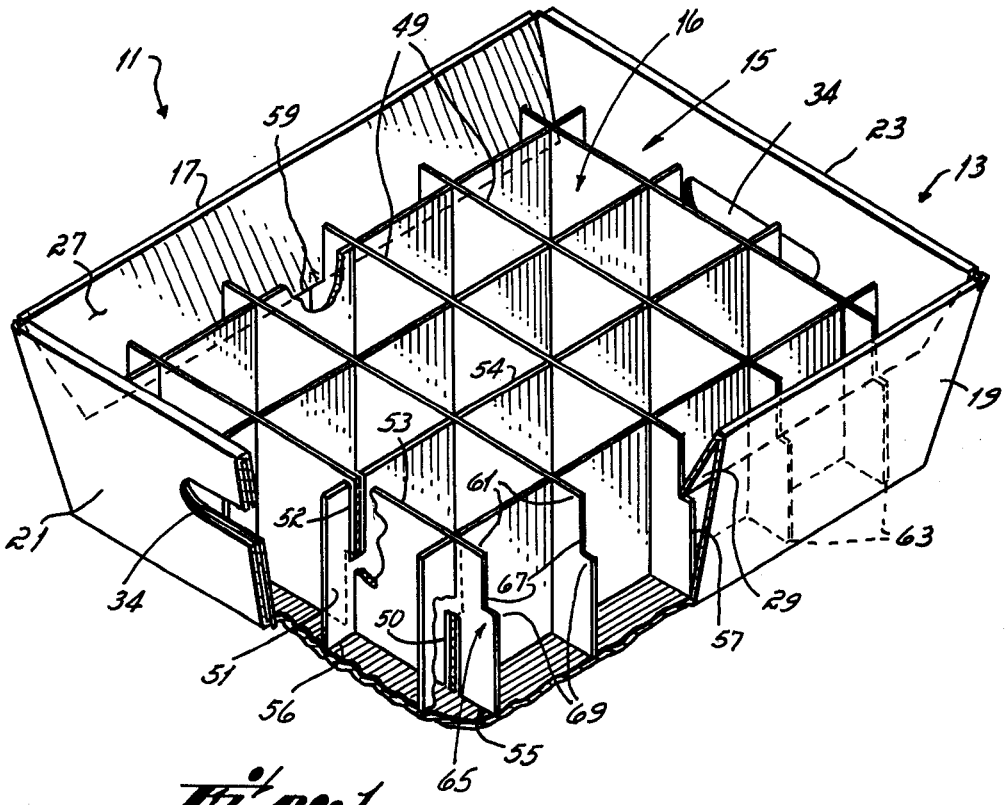
FIG. 1 is an isometric view in partial cross section of the container of this invention wherein the insert is disposed in the interior of the enclosure.

Referring now to the drawings, the container of this invention is shown and labeled with reference numeral 11. As mentioned above, the container 11 is formed in two parts including a five-sided enclosure 13 adapted to receive and secure a partitioned insert 15.

Figure 2:
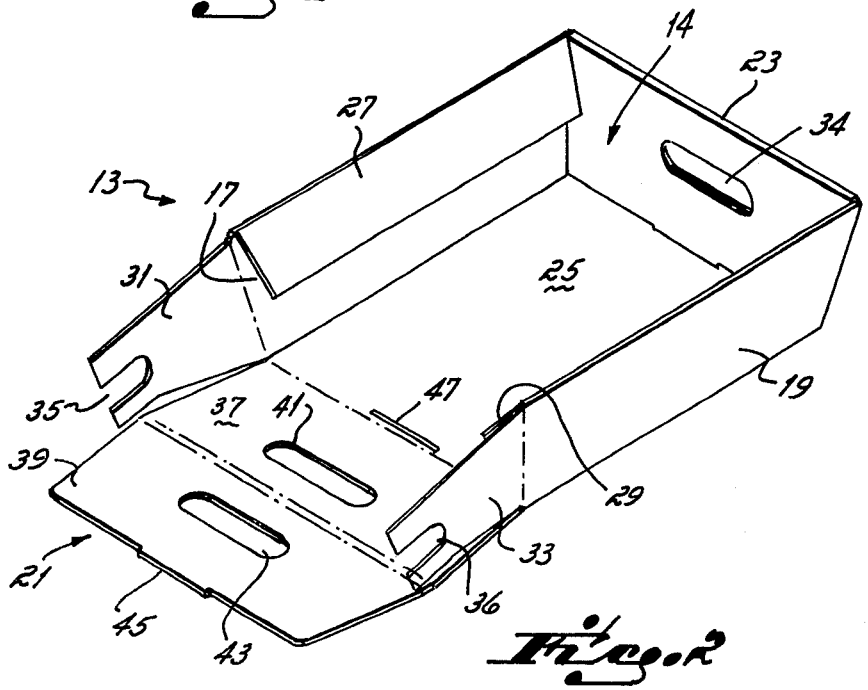
FIG. 2 is an isometric view of the enclosure portion of the container of this invention in a partially unfolded condition.

Considering first the enclosure 13 and referring to FIG. 2, the enclosure 13 is formed from a single blank of sheet material such as cardboard of other materials which may be folded. As shown in FIG. 2, enclosure 13 comprises a pair of side walls 17 and 19, end walls 21 and 23 and a bottom section 25 forming an open interior 14. Each side wall 17, 19 is connected to the bottom section 25 at one end and folded in an upright position at a slight angle to the bottom section 25. The side walls 17, 19 are each formed with an anchoring flap 27, 29, respectively, and the anchoring flaps 27, 29 are foldable inwardly and downwardly toward the interior 14 of bottom section 25. An extension flap 31 is foldably connected at each end of side wall 17, and an extension flap 33 is foldably connected at each end of side wall 19. For purposes of illustration, only the extension flaps 31, 33 on one end of the side walls 17, 19 are shown in the drawings. The end of extension flaps 31, 33 not connected to side walls 17, 19 are formed with generally U-shaped cutouts 35, 36, respectively. In forming the enclosure 13, as discussed below, the extension flaps 31, 33 at each end of side walls 17, 19 are foldable inwardly relative to the side walls 17, 19 such that the extension flaps 31, 33 meet and cutouts 35, 36 form an essentially continuous opening.

The end walls 21, 23 are each formed with a first panel 37 disposed between and foldably connected to the bottom section 25 and a second panel 39. The first panel 37 is formed with a slot 41 and the second panel 39 is formed with a slot 43. In addition, a tab 45 is formed on the edge of second panel 39 opposite its folded connection to first panel 37. A slit 47 having dimensions approximately equal to those of tab 45 is formed at each end of bottom section 25 immediately adjacent the first panel 37 of end walls 21, 23.

The enclosure 13 is formed in the following manner. The side walls 17, 19 are folded in an upright position at a slight angle relative to bottom section 25. Extension flaps 31, 33 at each end of side walls 17, 19 are then folded inwardly close to or contact with one another such that their cutouts 35, 36 align. The first panel 37 of end walls 21, 23 is then folded upright at an angle to bottom section 25 and into contact with the extension flaps 31, 33 of the side walls 17, 19. The slot 41 formed in first panel 37 of the end walls 21, 23 aligns with the cutouts 35, 36 formed therein. Finally, the second panel 39 of end walls 21, 23 is folded inwardly and downwardly toward bottom section 25 over the extension flaps 31, 33 such that the extension flaps 31, 33 are sandwiched between the first panel 37 and second panel 39 of end walls 21, 23. The second panels 39 are locked into place by inserting their tabs 45 within the slits 47 formed in bottom section 25. In the locked position of end walls 21, 23, the slot 43 of second panel 39 aligns with the slot 41 of first panel 37 and the cutouts 35, 36 in extension flaps 31, 33 to form a handle 34 for carrying the container 11. The enclosure 13 is thus completely formed with a bottom section 25, side walls 17, 19, end walls 21, 23 and an open interior 14.

The enclosure 13 is now ready to receive insert 15 to form the complete container 11. Insert 15 includes a plurality of first partitions 49 and second partitions 51 which are planar, rectangular-shaped sections formed of sheet material such as cardboard or any other suitable material. The first partitions 49 are disposed in a spaced, parallel array and the second partitions 51, also disposed in a spaced, parallel array, are connected perpendicularly to the first partitions 49 forming a plurality of compartments 16 in the insert 15. The insert 15 is disposed within the open interior of enclosure 13 such that the first partitions 49 extend generally perpendicularly to the side walls 17, 19 and the second partitions 51 extend generally perpendicularly to the end walls 21, 23.

Each of the first partitions 49 include an upper edge 53, lower edge 55 and opposite ends 57, 59 thus forming a pair of upper corners 61 and lower corners 63. An L-shaped cutout or notch 65 is formed in both of the upper corners 61 of each first partition 49. The notches 65 include a vertical edge 67 extending a pre-determined distance downwardly from the upper edge 53 toward the lower edge 55 to a ledge section 69. The ledge section 69 extends outwardly from the vertical edge 67 to the ends 57, 59 of first partitions 49, generally parallel to the bottom section 25.

As shown in FIG. 1, the anchoring flaps 27, 29 of side walls 17, 19, respectively, are folded inwardly toward the open interior 14 of enclosure 13 prior to the insertion of the partition insert 15. The assembled partition insert 15 is then inserted into the assembled enclosure 13. Upon insertion of the insert 15 into the enclosure 13, the lower corners 63 of the first partitions 49 engage the anchoring flaps 27, 29 and force those flaps outwardly into engagement with the side walls 17, 19 of the enclosure. After the ends 57, 59 of the first partitions 49 have moved past the inwardly folded anchoring flaps 27, 29, the resilience of the inwardly folded flaps 27, 29 causes those flaps to spring back and be urged inwardly into the notches 65 of first partitions 49. The anchoring flaps 27, 29 are thereby resiliently urged over the horizontal ledge sections 69 of the first partitions 49 and into engagement with the vertical edge 67. The anchoring flaps 27, 29 are sized to engage the vertical edges 67 at an acute angle when seated within notches 65 so that outward movement of insert 15 from the enclosure 13 is resisted by the frictional engagement between anchoring flaps 27, 29 and vertical edges 67.

In the embodiment of the invention shown in the figures, the anchoring flaps 27, 29 are sized to extend beyond the vertical edge 67 of notches 65 with the anchoring flaps 27, 29 in an unfolded position parallel to the bottom section 25. Thus, upon insertion of the partition insert 15 within the enclosure 13, anchoring flaps 27, 29 are flexed and folded inwardly into engagement with the side walls 17, 19 as they ride along the vertical edges of the ends 57, 59 of the first partitions 49. This arrangement provides tight engagement between the anchoring flaps 27, 29 and first partitions 49 to assure that the insert 15 remains in place within the enclosure 13. It is also contemplated that other configurations of notches 65 which create frictional engagement between the vertical edge 67 and the leading edge of anchoring flaps 27, 29 when flaps 27, 29 are seated within notches 65, are within the scope of this invention.

As shown in FIG. 1, the connection between partitions 49, 51 is accomplished by interengaging slots formed in each. The first partitions 49 are formed with a number of spaced slots 50 which extend upwardly from their lower edge 55 part way toward their upper edge 53. The second partitions 51 are each formed with spaced slots 52 which extend downwardly from their upper edge 54 part way toward their lower edge 56, approximately the same length as slots 50. Partitions 49, 51 are interconnected to form insert 15 by sliding first partitions 49 over second partitions 51 so that the slots 50, 52 engage one another. With slots 50, 52 fully engaged, the upper edges 53, 54 of first and second partitions 49, 51, respectively, are disposed in the same plane. In addition, by forming insert 15 with the first partitions 49 disposed over second partitions 51, separation of the partitions 49, 51 is prevented in the event container 11 is turned upside down and the insert 15 is retained in the enclosure 13 by anchoring flaps 29 as discussed above.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A foldable container comprising:

an enclosure including a pair of side walls and a pair of end walls foldably connected to a bottom section, said side walls and end walls being adapted to fold in an upright, interconnected position relative to said bottom section to form said enclosure with an open interior, each of said side walls including an upper end formed with a flap having a bottom edge, said flaps being foldable inwardly into said open interior and downwardly with said bottom edge facing toward said bottom section;

an insert disposed in said open interior of said enclosure, said insert having a plurality of spaced, first partitions disposed generally perpendicular to said side walls of said enclosure, and a plurality of spaced, second partitions disposed generally perpendicular to said end walls, said first and second partitions intersecting and being connected together to form a plurality of compartments, each of said first partitions being a planar, generally rectangular-shaped section of sheet material having an upper edge, lower edge and end sections forming a pair of upper corners and a pair of lower corners, said upper corners of each of said first partitions being formed with an L-shaped notch adapted to receive said side wall flaps, said flaps of each of said side walls being folded downwardly so that said bottom edge thereof engages said L-shaped notch of said first partitions on both sides of said enclosure to secure said insert within said enclosure.

2. The container of claim 1 wherein said side walls include foldable flap portions at each end, said flap portions of opposite side walls being foldable inwardly generally parallel to said end walls and into close proximity with one another, each of said flap portions having an end formed with a cutout such that when folded inwardly parallel to said end walls said flap portions at each end of said side walls form a continuous cutout.

3. The container of claim 1 wherein said end walls are each formed with first and second panels, said first panel being disposed between and foldably connected to said bottom section and said second panel, said first panel being foldable in an upright position generally perpendicular to said bottom section and said second panel being foldable inwardly toward said interior of said enclosure and downwardly into engagement with said bottom section.

4. The container of claim 3 wherein each of said first and second panels are formed with a cutout, said cutout of said second panel aligning with said cutout of said first panel in folding said second panel into engagement with said bottom section to form a handle in both end walls of said container.

5. The container of claim 3 wherein said bottom section is formed with a slot at either end and each of said second panels are formed with a tab, said tab of each of said second panels engaging said slots in said bottom section with said second panels folded downwardly to lock said second panels in place.

6. The container of claim 1 wherein each of said first partitions is a generally rectangular-shaped planar section of sheet material having an upper edge, lower edge and opposed end edges forming a pair of upper corners and a pair of lower corners, each of said first partitions being formed with a notch at the upper corners.

7. The container of claim 6 wherein said notch is a generally L-shaped cutout having a vertical edge extending downwardly from said upper edge of said first partitions at each end thereof toward said bottom edge to a ledge section, said ledge section extending outwardly from said vertical edge to said ends of said first partitions, said flap of said side sections being folded downwardly and inwardly into engagement with said ledge section and vertical edge of each of said first partitions to secure said insert within said container.

8. A foldable container comprising:

an enclosure including a pair of side walls and a pair of end walls foldably connected to a bottom section, said side walls and end walls being adapted to be folded in an upright, interconnected position relative to said bottom section to form said enclosure with an open interior, each of said side walls having an upper end formed with a flap, said flaps being foldable inwardly into said open interior and downwardly toward said bottom section.

an insert disposed in said open interior of said enclosure, said insert having a plurality of spaced, first partitions disposed generally perpendicular to said side walls of said enclosure, and a plurality of spaced, second partitions disposed generally perpendicular to said end walls, said first and second partitions intersecting and being connected together to form a plurality of compartments, each of said first partitions being formed of a planar, generally rectangular-shaped section of sheet material having an upper edge, lower edge and end sections forming a pair of upper and lower corners, said upper corners of each of said first partitions being formed with an L-shaped notch having a vertical edge extending downwardly from said upper edge toward said bottom edge to a ledge section, said ledge section extending outwardly from said vertical edge to said ends of said first partition, said flap of said side sections being folded downwardly into engagement with said ledge section and vertical edge of each of said first partitions to secure said insert within said container.

9. The foldable container of claim 8 wherein said flaps of said side walls are formed to seat within said notches of said first partitions with said flaps being disposed at an acute angle relative to said vertical edge of said notches.

10. The foldable container of claim 8 wherein said flaps of said side walls are formed to extend beyond said vertical edge of said notches in said first partitions with said flaps in a position generally parallel to said bottom section of said enclosure, said flaps being flexed inwardly and downwardly upon insertion of said insert into said enclosure, said flaps being resiliently biased into engagement with said notches to increase the frictional engagement between said flaps and said first partitions.

* * * * *